US005626283A

United States Patent [19]

Mellon

[11] Patent Number: 5,626,283

[45] Date of Patent: May 6, 1997

[54] CONTAINER FOR FOOD AND CONDIMENTS

[75] Inventor: Mark Mellon, Covington, Va.

[73] Assignee: Westvaco Corporation, New York, N.Y.

[21] Appl. No.: 598,122

[22] Filed: Feb. 7, 1996

[51] Int. Cl.[6] ..... B65D 25/04

[52] U.S. Cl. ..... 229/120.13; 229/122.1; 229/221; 229/400

[58] Field of Search ..... 229/120.08, 120.13, 229/120.18, 122, 122.1, 123, 167, 210, 221, 400

[56] References Cited

U.S. PATENT DOCUMENTS

| | | | |
|---|---|---|---|
| 2,886,232 | 5/1959 | Leone | 229/122.1 |
| 2,891,711 | 6/1959 | Early | 229/122.1 X |
| 2,907,512 | 10/1959 | Leone | 229/221 X |
| 3,568,911 | 3/1971 | Bebout | 229/122.1 X |
| 4,186,866 | 2/1980 | Zicko | 229/221 |
| 4,915,235 | 4/1990 | Roosa | 229/122 X |
| 4,955,528 | 9/1990 | Schluckebier | 229/120 |
| 5,137,210 | 8/1992 | Hibbs | 229/120 |
| 5,417,364 | 5/1995 | Shaw | 229/400 |
| 5,458,272 | 10/1995 | Ward-Weber | 229/122.1 |

*Primary Examiner*—Allan N. Shoap
*Assistant Examiner*—Christopher J. McDonald

[57] ABSTRACT

A combination container for food and condiments is formed from a one piece blank of paperboard material. The finished container includes a first compartment in the shape of a scoop for holding the food product and a second compartment in the form of a pouch which can be extended outwardly from the first compartment for condiments. The second compartment is collapsed against one wall of the first compartment when not in use for easy stacking of the containers.

7 Claims, 2 Drawing Sheets

CONTAINER FOR FOOD AND CONDIMENTS

BACKGROUND OF INVENTION

The present invention relates generally to paperboard food containers and more particularly to a combination food and condiment container for use primarily in serving fast food products such as french fries, chicken nuggets, fish and the like.

Paperboard food containers are well known in the fast food industry and have been manufactured in a variety of configurations for specific food products. Nevertheless, certain general characteristics of these containers have become functional beyond merely holding the food products. For example, it is desirable that such containers are collapsible so that they can be folded flat for shipping. Meanwhile, when the containers are partially or fully open, they should be stable and capable of being nested one within the other. In addition, when opened, such containers should be capable of being used as a scoop for picking up food products. And finally, since many of the food products served in such containers are ordinarily eaten with condiments such as catsup, tarter sauce, or the like, it is desirable to include within or attached to the container a space or provision for keeping condiments.

Prior art examples of containers that satisfy these criteria include U.S. Pat. No. 4,955,528 which discloses what is essentially a scoop type carton with two internal compartments, one for the food product and the other for the condiment; U.S. Pat. No. 5,137,210 which discloses a combination beverage cup with an attached side pouch for food; and, U.S. Pat. No. 5,417,364 which discloses a scoop type carton with an externally attached collapsible shelf for supporting a condiment substance, i.e., catsup in a cup. Nevertheless, none of these prior art attempts fully satisfy the purposes of a combination food product and condiment container as accomplished by the present invention.

SUMMARY OF INVENTION

It is a broad object of the present invention to provide a combination food and condiment container which can be manufactured from a one piece blank cut from paperboard stock.

It is a further object of the invention to provide a paperboard food container having a first scoop-type compartment for holding a food product and a second pouch-type compartment, which is retractable toward and away from the first compartment, for holding a condiment product.

It is another object of the invention to provide a combination food container which can be nested and stacked for storage. Another object is to provide a combination food container that can serve as a scoop for picking up the food product, and wherein the condiment compartment can accept condiment substances directly.

Accordingly, it is a primary object of the present invention to provide a combination food and condiment container so designed that the combination container can be held with one hand to enable an individual to eat the food product more conveniently without the probability of spillage.

The present invention accomplishes these objects and others by cutting and scoring a one piece blank from paperboard stock material. The blank includes conventional front, rear, bottom and overlapping side walls that are normally associated with a scoop-type french fry carton (i.e., scoop compartment). However, in order to provide the condiment compartment (i.e. pouch compartment) of the present invention, the blank further includes an auxiliary flap of paperboard material foldably attached to what is nominally considered the top edge of the front wall of the scoop compartment. The auxiliary flap is cut and scored to provide the panels necessary to construct the pouch compartment. In one embodiment of the present invention, the auxiliary flap is divided into a first panel foldably attached to the front wall of the scoop compartment, an intermediate panel detachably secured to the front panel and a second panel foldably attached to the intermediate panel. In another embodiment, the auxiliary flap is divided into a first panel foldably attached to the front wall of the scoop compartment and a second panel foldably attached to the first panel which corresponds to the intermediate panel of the first embodiment. The intermediate panel of the first embodiment and corresponding panel of the second embodiment are each provided with a pair of hingedly attached wing flaps located at each side thereof. Each of the wing flaps includes integral stop elements to be described in more detail hereinafter. Meanwhile the front wall of the scoop compartment includes a flap panel formed in the front wall by perforated lines along at least three sides and hinged to the front wall along another side.

The folding and gluing sequence for forming the combination container of the present invention depends upon which embodiment of the invent ion is being constructed. In either case, the panels of the auxiliary flap are folded inwardly and adhered to the inside of the front wall of the scoop compartment in preparation for forming the pouch compartment. After completing this step, the front and rear walls of the scoop compartment are folded toward one another about their connections to the bottom panel to bring the side walls of the scoop compartment into overlapping engagement where they are adhered to one another so as to capture between them the wing flaps of the pouch compartment. This is accomplished for one embodiment of the present invention with a glue application, a first forward fold, a second glue application and a reverse fold, and for the other embodiment with a first forward fold, a single glue application and a second forward fold. The designations forward and reverse to define the folding steps is arbitrary and simply means that forward folds are made in one direction, e.g. upwardly, and reverse folds are in the opposite direction, e.g. downwardly as shown in the drawing.

These and other features and advantages of the invention disclosed herein will become more apparent upon consideration of the following detailed description and accompanying drawings wherein like reference characters designate corresponding parts throughout the several views.

DETAILED DESCRIPTION

Figure 1:
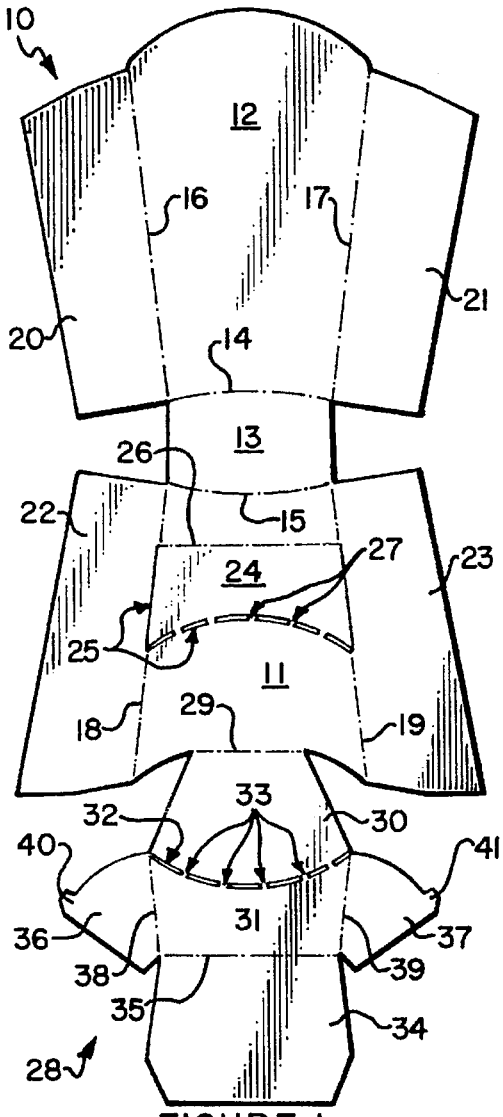
FIG. 1 is a plan view of a unitary paperboard blank showing a first embodiment for forming the container of the present invention.

Referring now to FIG. 1 of the drawing, numeral 10 denotes a unitary blank of paperboard from which the combination container of the present invention may be constructed. Other sheet materials which are stiff, resilient and foldable may be used instead of paperboard. Numerals 11 and 12 correspond respectively to the front and rear walls of the scoop compartment of the container, and numeral 13 is the bottom wall which is preferably connected to walls 11 and 12 along arcuate score lines 14, 15. The front and rear walls 11, 12 are each of conventional configuration in the general form of rectangles which are slightly tapered outwardly from bottom-to-top. The long sides of each rectangle are provided with score lines 16, 17 and 18, 19 to define side forming flaps 20, 21 and 22, 23 which are used to form the scoop compartment of the container in a conventional manner. Front wall 11 further includes a flap 24 formed therein by a perforated cut line 25 and a fold line 26. Perforated cut line 25 preferably includes a curved first portion that extends from one side of the front panel to the other between score lines 18, 19, and a pair of opposed portions which lie along the score lines 18, 19 and extend between the ends of the curved first portion and the ends of the fold line 26. The curved first portion of perforated cut line 25 is not fully cut in the preparation of the blank since it preferably includes spaced nicks 27 along its length to keep flap 24 within the plane of the blank 10 during the container forming process. The flap element 24 in front wall 11 provides a reinforcing means for the front panel of the pouch compartment of the container. This panel is preferably reinforced since it is the panel that is used to pull the pouch compartment of the container from its retracted to its extended condition for use. The remainder of blank 10 of FIG. 1 consists of an auxiliary flap 28 foldably attached to the front wall 11 along a score line 29. The auxiliary flap 28 is cut and scored to provide the primary elements of the pouch compartment of the container.

Figure 1A:
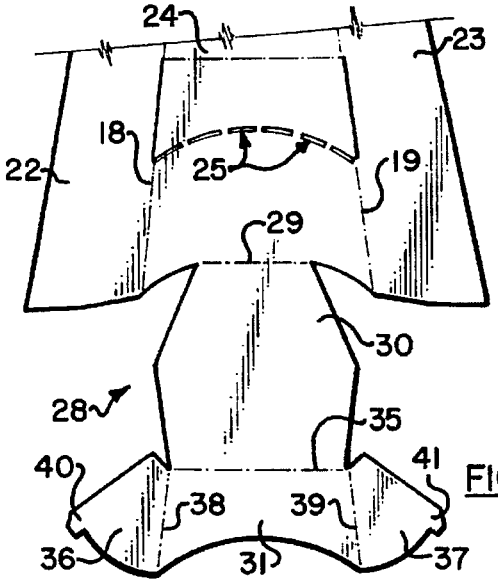
FIG. 1(A) is a partial plan view of a modified blank structure.

In the embodiment shown in FIG. 1, auxiliary flap 28 is divided into a first panel 30 foldably attached to front wall 11 along a score line 29; an intermediate panel 31 which is attached to first panel 30 along a perforated cut line 32; and a second panel 34 which is foldably attached to the intermediate panel 31 along a fold line 35. Perforated cut line 32 is of the same general shape and length as perforated cut line 25 in the front wall 11 of the scoop compartment. Also, as in the case of flap element 24, the intermediate panel 31 is designed to be separable from panel 30 along perforated cut line 32, since it is normally retained in place by a plurality of nicks 33 as is well known in the art. The nicks 33 keep the intermediate panel 31 within the plane of the blank 10 while the container is being formed. Intermediate panel 31 further includes a pair of wing flaps 36, 37 foldably attached to panel 31 at each side thereof along fold lines 38, 39; and each wing flap 36 and 37 includes a stop element 40 and 41, respectively. Meanwhile, in the modified embodiment of the blank structure 10 shown in FIG. 1(A), auxiliary flap 28 is divided into a first panel 30 and a panel 31 corresponding to the intermediate panel 31 of FIG. 1 foldably attached to one another along a score line 35. Also, as in the case of FIG. 1, the panel 31 of the FIG. 1(A) embodiment further includes a pair of wing flaps 36, 37 foldably attached at each side thereof along fold lines 38, 39, and each wing flap 36, 37 includes a stop element 40, 41 respectively located on the outer end thereof. However, notwithstanding the slightly different blank structures shown in FIGS. 1 and 1(A), the combination containers formed with either blank are substantially the same.

For example, using either blank structure, the primary walls of the scoop compartment of the combination container will be seen to comprise front and rear walls 11, 12 connected to bottom wall 13, and side walls formed by overlapped side flaps 20, 22 and 21, 23 respectively. Meanwhile, the pouch compartment of the combination container includes a front wall formed by adhering flap 24 and panel 31 together and side walls consisting of the wing flaps 36, 37. The rear wall of the pouch compartment comprises either panel 34 using the blank structure shown in FIG. 1 or panel 30 using the blank structure shown in FIG. 1(A).

Figure 2:
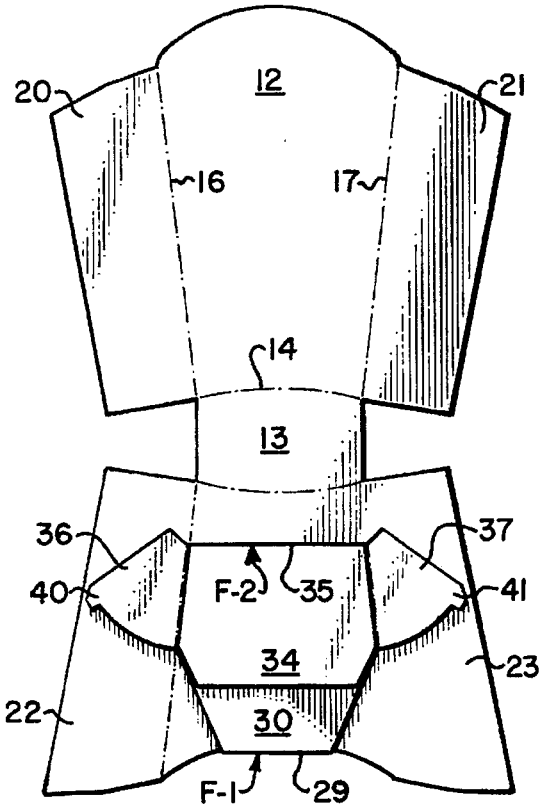
FIG. 2 is a plan view of the blank of FIG. 1 in its pre-glued, folded construction.

FIG. 2 illustrates the method of construction using the blank of FIG. 1. With the inside surface of the blank 10 facing up, a first glue application is made either to the inner surfaces of panels 30, 31 or to the inner surface of panel 24 and the inner surface of front wall 11 between the arcuate portion of perforated cut line 25 and fold line 29. A first fold F-1 is then made along fold line 29 to adhere panel 24 of front wall 11 to intermediate panel 31 of auxiliary flap 28, and panel 30 of auxiliary flap 28 to front wall 11. A second glue application is made to the now exposed outer surface of panel 34 or to panel 29, and a second reverse fold F-2 is made along fold line 35 to adhere these panels to one another. The resultant folded and glued construction is shown in FIG. 2. Meanwhile, using the blank structure shown in FIG. 1(A), the adhesive application and folding steps are as follows. With the inside surface of the blank facing up, a first forward fold F-1 is made along fold line 35 and adhesive is applied to the now exposed outer surface of panel 31 and to the inner surface of panel 30 adjacent to panel 31 Subsequently, a second forward fold F-2 along score line 29 causes panel 31 to become adhered to the inner surface of flap 24 of front wall 11 while the inner surface of front wall 11 between fold line 29 and cut line 25 is adhered to the inner surface of panel 30 adjacent to panel 31. The resultant folded and glued construction is shown in FIG. 2(A).

Figure 2A:
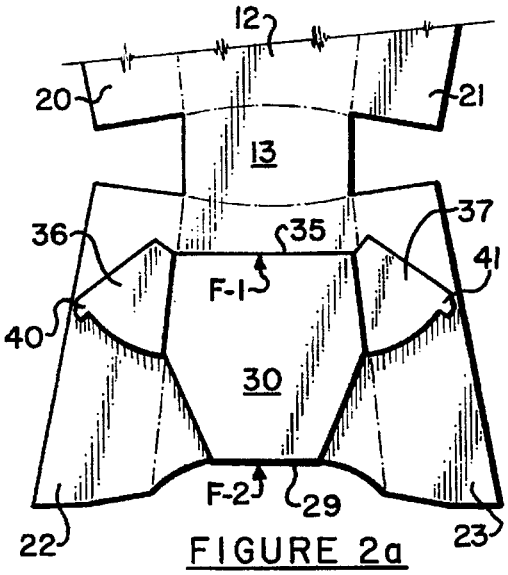
FIG. 2(A) is a partial plan view of the modified blank of FIG. 1(A) pre-glued and folded.
Figure 3:
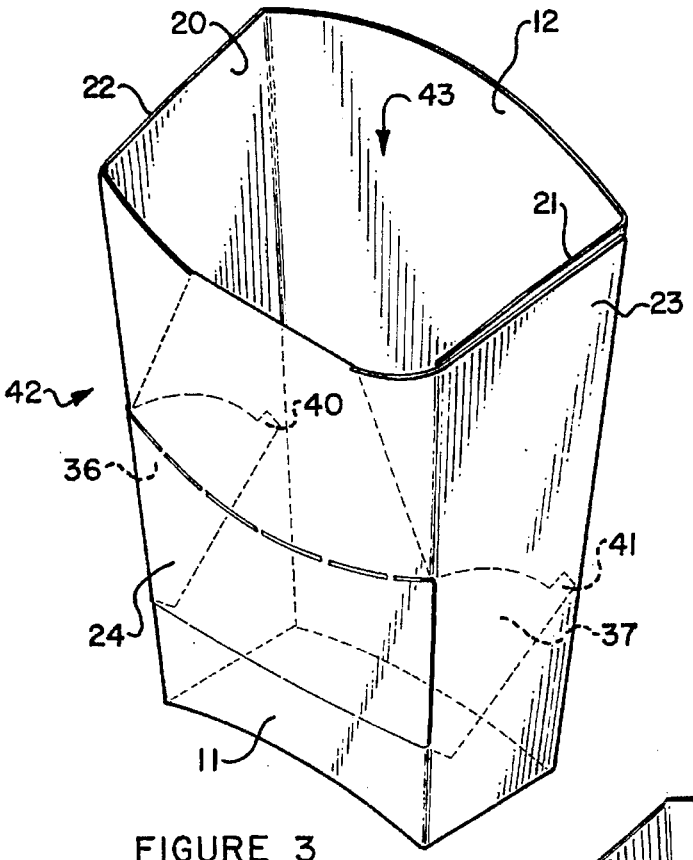
FIG. 3 is a perspective view of the container erected from either of the blanks of FIGS. 1 or 1(A), with the pouch compartment retracted; and, FIG. 4 is a perspective view of the container of FIG. 3 with the pouch compartment extended into an open condition.

Using either of the folded and glued constructions shown in FIGS. 2 or 2(A), the final containers are completed in a conventional manner by folding the front and rear walls 11, 12 of the scoop compartment into an upright condition about bottom wall 13 along fold lines 14 and 15. The side flaps 20 and 22 are then folded into overlapping engagement to capture wing flap 36, while side flaps 21 and 23 are folded into overlapping engagement to capture wing flap 37. The side flaps are subsequently adhered together in their overlapped condition to yield the completed container 42 shown in FIG. 3. However, even though the two embodiments yield the same general container construction, each embodiment has certain distinctions. For example, when using a paperboard blank having an uncoated inner surface and a coated outer surface adapted to accept printing, all of the interior surfaces of the scoop compartment of the combination container produced are uncoated, except in the case of the FIG. 1(A) embodiment wherein a portion of the interior surface of the front wall has an exposed coated surface from auxiliary flap 28. It is desirable in many cases to provide a combination container wherein the scoop compartment interior surface are uncoated for soaking up excess oils or grease associated with the food product. Moreover in some cases, it would be equally desirable to expose the condiment product to uncoated paperboard surfaces. Thus, because of the manner in which the two embodiments herein are designed, the blank structure of FIG. 1 yields a pouch compartment wherein all of the interior surfaces that might come into contact with the condiment product are coated to reduce absorption and wicking. Meanwhile, with the blank structure of FIG. 1(A), all interior surfaces of the pouch compartment are uncoated to provide some absorptive capacity. Accordingly, by providing at least two embodiments for constructing the container of the present invention, the user may select the blank structure most appropriate for the food product/condiment product intended to be used.

Referring once again to FIG. 3, it will be noted that the fully formed containers 42, shown with the pouch compartment retracted, may be stacked or nested in a conventional manner employed hereinbefore for such food cartons. Likewise, the scoop compartments 43 of such formed containers may be filled in the same manner as accomplished in the past with conventional scoop-type food cartons. However, after being filled in the usual manner, the customer may then open the pouch compartment 44 as shown in FIG. 4 by breaking the aforementioned nick elements, to provide a place for holding a suitable condiment product.

Figure 4:
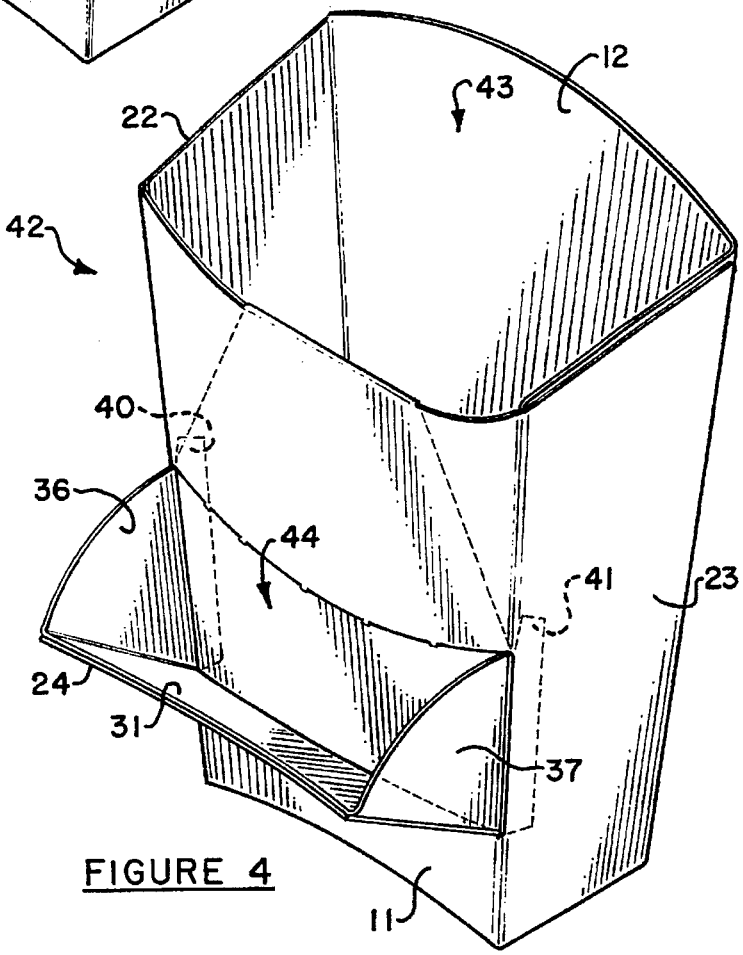

Referring now to FIG. 4, a container 42 is illustrated with the pouch compartment 44 extended for use. This step is accomplished by breaking the nick elements 27 between panel 24 and front wall 11 of the blanks of FIGS. 1 and 1(A), and in addition, the nick elements 33 of the blank of FIG. 1, to free the previously glued panels 24 and 31 from the front wall 11 of the container. This allows the combined panels 24 and 31 to be pulled outwardly causing the wing flaps 36, 37 to be extended from between overlapping side flaps 20, 22 and 21, 23 respectively (note the wing flaps shown in phantom lines in FIG. 3). The wing flaps 36, 37 are permitted to extend outwardly from the front wall 11 until the stop elements 40, 41 engage the upper extremity of each portion of perforated cut line 25 in front wall 11 lying along the score lines 18, 19. At this point, the pouch compartment 44 is fully opened and the user can fill the pouch compartment with the appropriate condiment product suitable for the food product in the scoop compartment 43 of the combined container. Because of the manner in which the panels of the pouch compartment are folded and glued, the condiment product remains completely isolated from the food product in the scoop compartment. After consuming the food product, the pouch compartment may be readily closed to trap any residue of condiment product remaining therein making the discarded container neater and more sanitary than previous containers.

Thus it may be seen that the primary function of the present invention is to provide a user with a container capable of holding two different products at the same time within the same package. This is accomplished by providing a container with two separate compartments, one of which is normally retracted out of the way prior to use. This allows the consumer to determine whether or not to use the added feature. The retracted or pouch compartment is designed to simply pivot about a common score line between the pouch compartment and the main or scoop compartment of the combination container.

The foregoing description of the preferred embodiments of the invention have been presented for the purpose of illustration and description. It will be apparent that modifications or alterations in accordance with the present invention can be made by those skilled in the art, without departing from the scope and spirit thereof, and it is not intended to be exhaustive or to limit the invention to the precise forms disclosed. Many modifications and variations are possible in light of the foregoing teachings. Thus such modifications, substitutions and equivalents may be made without departing from the scope of the invention as set forth in the appended claims.

What is claimed is:

1. A combination container having two separate compartments formed from a single blank of foldable material for holding two different products comprising, (a) a scoop compartment having integral front, rear and bottom walls connected together along fold lines and side walls formed by overlapping side flaps foldably attached to each side of said front and rear walls; and, (b) a pouch compartment located adjacent to and adapted to be extended outwardly from the front wall of the scoop compartment, said pouch compartment having a front panel, a pair of side panels foldably attached to the front panel and a rear panel, each being formed from auxiliary blank material that is foldably attached to the front wall of the scoop compartment.

2. The container of claim 1 wherein the front panel of said pouch compartment is reinforced by a reinforcing flap cut from and foldably attached to the front wall of the scoop compartment having the same size and shape as the pouch compartment front panel.

3. The container of claim 2 wherein the front panel of the pouch compartment and the reinforcing flap are adhered together.

4. The container of claim 3 wherein the side panels of the pouch compartment comprise wing flaps which are captured between the overlapped side wall flaps of the scoop compartment when the pouch compartment is closed.

5. The container of claim 4 wherein the wing flaps each include stop members which keep the wing flaps from being released from their captured condition when the pouch compartment is opened.

6. The container of claim 5 wherein the reinforcing flap portion of the front wall of the scoop compartment is retained in the plane of the front wall by a plurality of nick elements until such time that the pouch compartment is opened.

7. A one piece blank of foldable material cut and scored for a combination container having two separate compartments comprising:

(a) a primary blank portion comprising front, rear and bottom walls connected together along fold lines, side flaps connected to the side edges of the front and rear walls along fold lines and a reinforcing flap of generally rectangular shape cut from said front wall along at least three edges and foldably attached to the front wall along another edge; and, (b) an auxiliary blank portion comprising a first panel foldably attached to the front wall of the primary blank portion, an intermediate section releasibly attached to the first panel along a perforated cut line including a plurality of nicks, a second panel foldably attached to the intermediate section along a fold line, and a pair of wing flaps, each including stop elements on the ends thereof, foldably attached to the side edges of said intermediate panel.

* * * * *